United States Patent [19]

Gillis

[11] 4,414,993

[45] * Nov. 15, 1983

[54] FLEXIBLE VAULT STRUCTURE HAVING MULTIPLE PIECE POLES

[76] Inventor: Robert E. Gillis, P.O. Box 67, Aptos, Calif. 95003

[ * ] Notice: The portion of the term of this patent subsequent to May 5, 1998 has been disclaimed.

[21] Appl. No.: 316,089

[22] Filed: Oct. 29, 1981

Related U.S. Application Data

[63] Continuation-in-part of Ser. No. 290,661, Aug. 6, 1981, abandoned.

[51] Int. Cl.[3] ..... A45F 1/16

[52] U.S. Cl. ..... 135/104; 135/115; 135/119; 52/80

[58] Field of Search ..... 135/2, 3 E, 15 CF, 3 R, 135/1 R, 3 A, 4 R, 4 A, 5 R, 5 A, 5 B, 7.1 R, 7.1 A; 52/80

[56] References Cited

U.S. PATENT DOCUMENTS 3,480,023 11/1969 McConnell et al. ..... 135/1 R 4,265,259 5/1981 Gillis ..... 52/80 X

*Primary Examiner*—Richard J. Apley

*Assistant Examiner*—Stephen R. Crow

*Attorney, Agent, or Firm*—Robert G. Slick

[57] ABSTRACT

A flexible vault structure is provided which includes a plurality of stressed poles each of which poles is composed of two or more short rod like members held together by connector elements.

4 Claims, 8 Drawing Figures

FLEXIBLE VAULT STRUCTURE HAVING MULTIPLE PIECE POLES

REFERENCE TO RELATED APPLICATION

This application is a continuation-in-part of my application Ser. No. 290,661 filed Aug. 6, 1981 now abandoned.

SUMMARY OF THE INVENTION

The present invention relates to a vault structure which is very similar to my prior U.S. Pat. No. 4,265,260. In said patent, a flexible vault structure is provided wherein the structure includes a plurality of stressed poles which are held in their stressed condition by a member, such as a membrane, strung between the poles. Such a vault structure can be used as a storage vessel, tent, kite or the like.

The present invention provides a structure substantially the same as that of my prior patent except that instead of using long continuous poles, I use a plurality of short rods, some of which are connected in end to end relationship by means of connectors. Thus it is not necessary to provide long poles, which are difficult to store and carry but instead, the entire structure can be fabricated of very short elements which are then connected together to form the supporting poles or rods of the finished vault structure.

As in my prior patent, the poles will cross each other at a number of points and at some or all of the crossings the poles will be attached to the membrane. This can be a simple loop which passes over a pair or more of crossed poles; in this case the crossing would ordinarily represent a coupling member, wherein a loop is passed over the crossing element and attached to the membrane by a clip such as that set forth in my U.S. Pat. No. 4,175,305. This can also be a cord which passes through a hole in the coupling member and the cord can also serve to hold the elements of the coupling member together. The crossing could also be attached directly to the membrane by gluing, sewing, riveting or the like. Naturally, other methods could be used to fasten the poles to the membrane.

Various other features and advantages of the invention will be brought out in the balance of the specification.

DESCRIPTION OF THE PREFERRED EMBODIMENT

Figure 1:
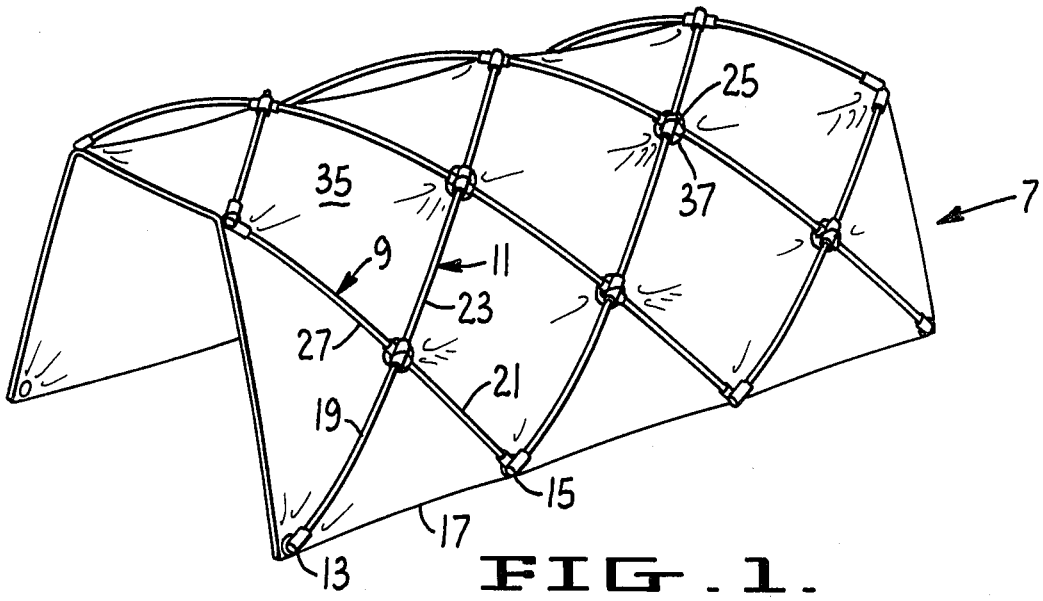
FIG 1 is a perspective view of a vault structure embodying the present invention.
Figure 2:
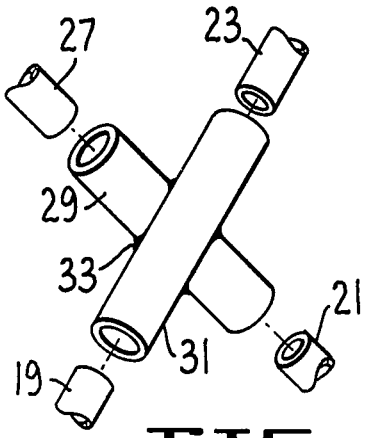
FIG. 2 is a enlarged partial perspective of one type of crossing member.

The vault structure of the present invention is generally designated 7 and it superficially appears substantially the same as the vault structure of my prior patent. A plurality of poles such as those generally designated 9 and 11, extend upwardly from the bottom points 13 and 15 of a terminal edge 17 and pass over completely across the vault. However, in the present invention, poles 9 and 11 do not consist of a single piece of material but instead consist of relatively short members such as those designated 19, 21, 23 and 27. Each of these short rods fits into a socket member such as that shown in FIG. 2 which consists of a cross of two connectors 29 and 31 which, in this instance, have been permanently fastened together as by the weld 33.

Figure 5:
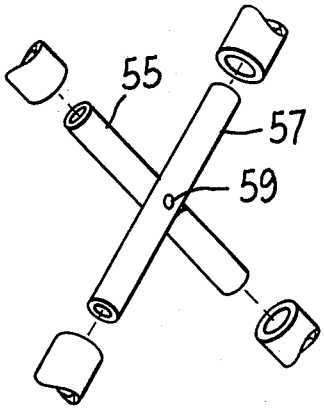
FIG. 5 illustrates another crossing member.
Figure 6:
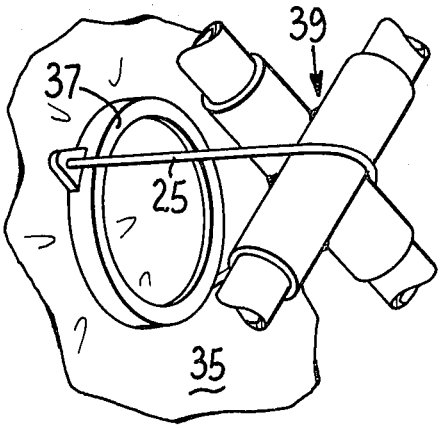
FIG. 6 is a perspective view showing how any of the crossing members can be attached to the membrane of the vault structure.

At each crossing, the connector is fastened to the membrane 35 of the tent and a convenient way of doing this is shown in FIG. 6. Here a ring 37 forms part of a clip as set forth in my prior U.S. Pat. No. 4,175,305 attached to a membrane 35 and a loop 25 passes over a crossing member, such as any of the members set forth in FIGS. 2–5, said crossing member being designated 39. Of course, other methods can be used of attaching the crossing members to the membrane of the vault.

Figure 3:
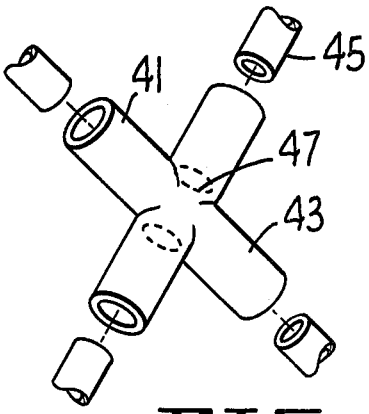
FIG. 3 is a perspective view of another type of crossing member.

In FIG. 3, another embodiment is shown, wherein the crossing member consists of two connectors 41 and 43 which intersect each other on a common plane. The rod elements 45 slip into the connectors and, if desired, stops 47 may be employed inside the connectors to prevent the rods from passing completely through and insuring that each rod will be gripped by a sufficient length of the connector element.

Figure 4:
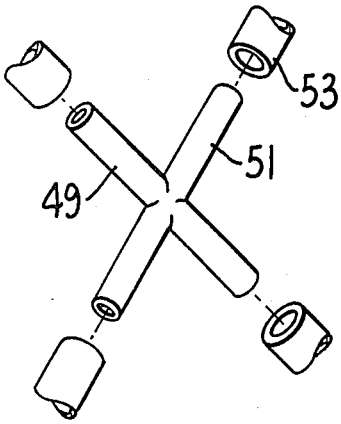
FIG. 4 is a perspective view of still another type of crossing member.

Still another embodiment of the invention is shown in FIG. 4 wherein the connector consists of small elements 49 and 51 which are fastened together in the form of a cross and which fit inside of the tubular members 53 which are connected together to form the complete pole which fastens over the top of the vault.

FIG. 5 shows a similar configuration where the two connectors 55 and 57 are merely fastened together by means of a pin 59.

Figure 7:
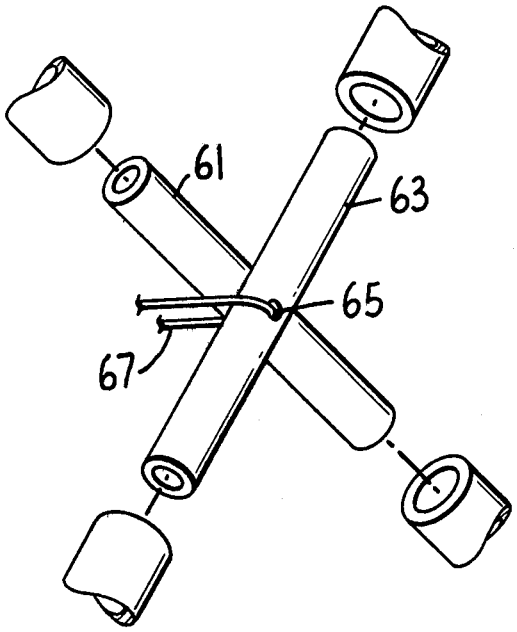
FIG. 7 illustrates a crossing member where two coupling members are held together by the cord which attaches the crossing to the membrane.

In FIG. 7 the crossing is formed by two connectors 61 and 63 each of which has a hole 65 therein. Cord 67 passes through the holes, serving both to hold the connectors together and to hold the connectors to the membrane by any suitable means.

Figure 8:
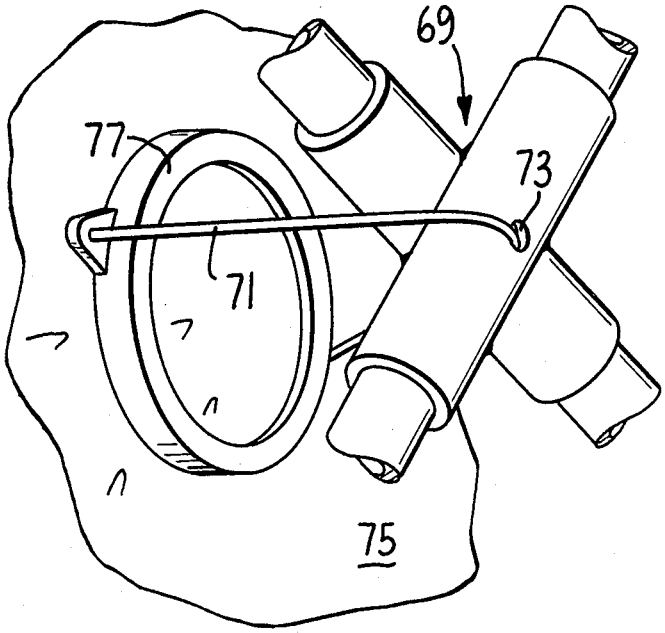
FIG. 8 is similar to FIG. 6 except that the cord passes through the coupling member.

In FIG. 8 the two connectors are fastened together by weld 69 and cord 71 passes through a hole 73 in the connectors and fastenes the connectors to the membrane 75 by means of clip 77.

Various changes can be made in the exact structure shown without departing from the spirit of the invention.

The subject matter to be claimed is:

1. A vault structure having an arcuate shape in cross section and a generally rectangular shape in plan, said vault structure extending from a plane and having no member from side-to-side in said plane comprising in combination:

a. a plurality of rod-like members, b. each of such rod-like members being held in tension by stress means and thereby formed into a generally arcuate shape, and a plurality of said rod-like members extending from the level of the plane on one side, over the top of the arcuate structure to the level of the plane on the opposite side, c. said stress means comprising a flexible member attached to said rod-like members at a plurality of points, d. said stress means forming a plurality of geometric cords with respect to said arcuate rod-like members and, e. at least some of said rod-like members consisting of short members having connectors for connecting said short members in end to end relationship.

2. The structure of claim 1 wherein said rod-like members cross each other and having cross-like connectors at crossing points with said flexible member being connected to said rod-like members at said cross-like connectors.

3. The structure of claim 1 wherein a cord passes over a crossing member to attach said member to said flexible member.

4. The structure of claim 2 having a cord passing through an opening in the crossing member.

* * * * *